US009403337B2

(12) United States Patent
Su

(10) Patent No.: US 9,403,337 B2
(45) Date of Patent: Aug. 2, 2016

(54) METHOD FOR MANUFACTURING A THERMOPLASTIC BAG

(71) Applicant: Frank F. Su, Cerritos, CA (US)

(72) Inventor: Frank F. Su, Cerritos, CA (US)

(73) Assignee: IPS INDUSTRIES, INC., Cerritos, CA (US)

( * ) Notice: Subject to any disclaimer, the term of this patent is extended or adjusted under 35 U.S.C. 154(b) by 490 days.

(21) Appl. No.: 14/105,803

(22) Filed: Dec. 13, 2013

(65) Prior Publication Data

US 2015/0165714 A1 Jun. 18, 2015

(51) Int. Cl.
*B31B 19/64* (2006.01)
*B65D 33/08* (2006.01)

(52) U.S. Cl.
CPC ..... *B31B 19/64* (2013.01); *B65D 33/08* (2013.01); *B31B 2219/148* (2013.01); *B31B 2219/269* (2013.01); *B31B 2219/6038* (2013.01); *B31B 2219/9093* (2013.01); *B31B 2237/20* (2013.01); *B31B 2237/403* (2013.01); *B31B 2237/406* (2013.01); *B31B 2237/60* (2013.01)

(58) Field of Classification Search
CPC ..... B31B 19/64; B31B 19/86; B31B 29/60; B31B 37/00; B31B 2219/269; B31B 2219/148; B31B 2219/146; B31B 2219/9093; B31B 2237/60; B31B 2237/403; B31B 2237/20; B31B 2237/40
USPC ..... 493/189, 218, 186, 936, 201, 934, 193, 493/86, 195, 202, 223
See application file for complete search history.

(56) References Cited

U.S. PATENT DOCUMENTS 3,618,478 A 11/1971 Piazze
3,620,884 A * 11/1971 Peterson ..... B29C 65/18 156/251
3,916,770 A * 11/1975 Hanson ..... B31B 29/00 493/189
3,924,521 A * 12/1975 Hanson ..... B31B 1/94 493/209
3,978,638 A * 9/1976 Sether ..... B31B 37/00 53/442
4,451,308 A * 5/1984 LeLoux ..... B29C 65/18 156/350
4,692,135 A * 9/1987 Johnson ..... B29C 65/18 156/461
4,717,262 A * 1/1988 Roen ..... B31B 37/00 383/104
4,848,930 A * 7/1989 Williams ..... B65D 33/065 383/10
4,986,804 A * 1/1991 Jensen ..... B29C 66/80 156/583.1
5,080,643 A * 1/1992 Mitchell ..... B29C 65/7437 156/308.4
5,135,463 A * 8/1992 Hyduk ..... B31B 1/28 493/133
5,135,464 A 8/1992 Buchanan
5,149,201 A * 9/1992 Benoit ..... B31B 19/36 383/120
5,246,416 A * 9/1993 Demura ..... B31B 19/36 493/439
5,938,337 A * 8/1999 Provan ..... B31B 19/90 383/120

(Continued)

*Primary Examiner* — Hemant M Desai
*Assistant Examiner* — Eduardo R Ferrero
(74) *Attorney, Agent, or Firm* — Law Office of Steven R. Olsen, PLLC; Steven R. Olsen

(57) ABSTRACT

The invention relates to a method for manufacturing a thermoplastic bag with a substantially flat and rectangular bottom. The bag may also include a carrying handle and/or a tab with a mounting hole.

9 Claims, 6 Drawing Sheets

(56) References Cited

U.S. PATENT DOCUMENTS 6,095,687 A * 8/2000 Dematteis ..... B29C 65/004 383/104
6,319,184 B1 * 11/2001 DeMatteis ..... B29C 65/004 493/186
6,440,051 B1 * 8/2002 Lauzon ..... B31B 19/90 383/204
6,942,100 B2 * 9/2005 Su ..... B31B 37/00 206/554
7,182,512 B2 * 2/2007 Bois Henri ..... B31B 19/90 383/120
7,186,025 B2 * 3/2007 Shepard ..... B31B 19/90 383/104
7,585,266 B2 * 9/2009 Baner ..... B31B 19/86 383/6
2003/0040412 A1 * 2/2003 Wilson ..... B31B 19/36 493/194
2003/0054929 A1 * 3/2003 Post ..... B31B 1/28 493/218
2003/0188514 A1 * 10/2003 Bois Henri ..... B31B 19/90 53/412
2004/0131285 A1 * 7/2004 Shepard ..... B31B 19/90 383/120
2005/0139508 A1 * 6/2005 Su ..... B31B 37/00 206/554
2005/0181923 A1 * 8/2005 Su ..... B31B 37/00 493/218
2006/0078233 A1 * 4/2006 Winiecki ..... B31B 19/86 383/104
2007/0107380 A1 * 5/2007 Shepard ..... B31B 19/90 53/412
2007/0133908 A1 * 6/2007 Bruns ..... B31B 19/90 383/95
2011/0019943 A1 * 1/2011 Piraneo ..... B31B 21/00 383/104

* cited by examiner

METHOD FOR MANUFACTURING A THERMOPLASTIC BAG

BACKGROUND

1. Field of Invention

The invention relates generally to the field of thermoplastic manufacturing. In particular, but not by way of limitation, the invention relates to a method for manufacturing thermoplastic bags having a substantially flat and rectangular bottom.

2. Description of the Related Art

Many types of bags are known and used in commerce. For example, clothing, food, and other retailers commonly use bags at the point-of-sale (POS) to facilitate the transport of goods by the customer. Bag features vary according to intended use. For many applications, a flat-bottomed bag with carrying handles is desirable. Typically, such bags are constructed of paper. Paper bags have many shortcomings, however. For instance paper bags are not waterproof. In addition, paper bags are often more expensive to manufacture than thermoplastic bags.

SUMMARY OF THE INVENTION

The invention seeks to overcome one or more of the limitations described above by providing a method for manufacturing a flat-bottomed bag with carrying handles from thermoplastic film. In an embodiment of the invention, the method includes receiving a thermoplastic film tube, forming a first and second gusset in the tube, slitting along a crease of an interior fold of the first gusset, welding support structures in the first and second gussets, seam welding and cutting the tube to form a bag, and punching a portion of the first gusset to form a handle. The invention also provides a bag that is manufactured by the process.

These and other features are more fully described in the detailed description section.

BRIEF DESCRIPTION OF THE DRAWINGS

Embodiments of the invention are described with reference to the following drawings, wherein.

DETAILED DESCRIPTION

Figure 1:
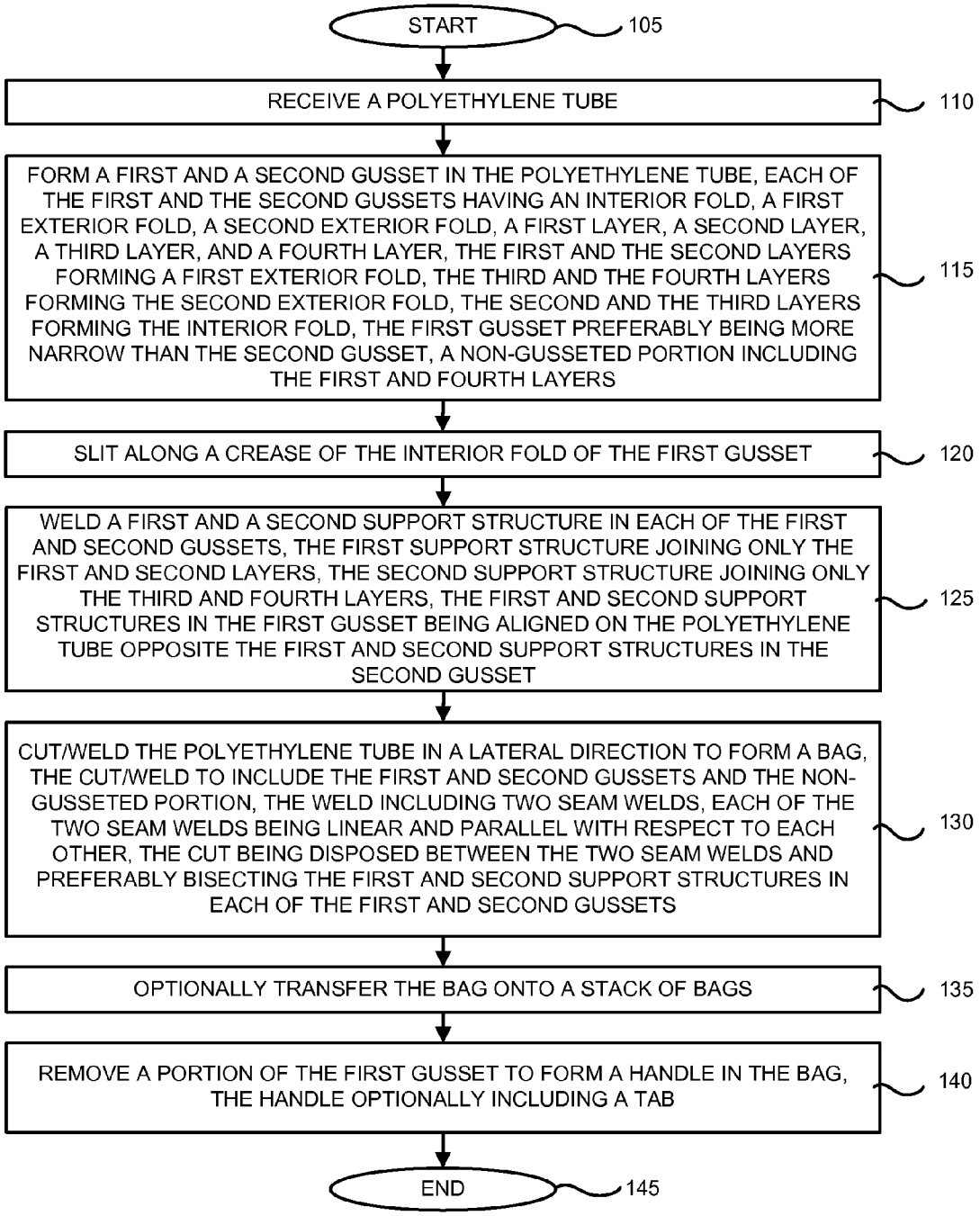
FIG. 1 is a flow diagram of a bag-manufacturing process, according to a first and second embodiment of the invention.

Embodiments of the invention are described with reference to FIGS. 1-12. Reference designators are reused for the same or similar features. The drawings are not to scale. Some features illustrated in the drawings have been exaggerated for descriptive clarity. Sub-headings are used in this section for organizational convenience but the disclosure of any particular feature(s) is/are not necessarily limited to any particular section or sub-section of this specification.

Manufacturing Process

FIG. 1 is a flow diagram of a bag-manufacturing process, according to a first and a second embodiment of the invention. After beginning in step 105, the process receives a polyethylene (PE) tube in step 110. Next, in step 115, the process forms a first and a second gusset in the polyethylene tube, for example using gusseting wheels. In a first embodiment, and with reference to FIGS. 2A and 3A, the first gusset 205 and the second gusset 210 are the same (or substantially the same) in width. In a second embodiment, and with reference to FIGS. 2B and 3B, the gusseting is asymmetrical: the first gusset 215 being more narrow than the second gusset 220.

Figure 4:
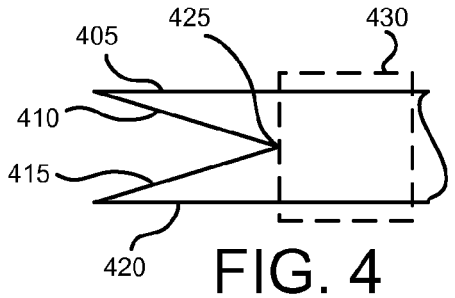
FIG. 4 is a sectional view of a gusseted polyethylene tube, according to the first and second embodiments of the invention.

FIG. 4 is a sectional view of a gusseted polyethylene tube, according to the first and second embodiments of the invention. FIG. 4 illustrates that each of the gussets 205, 210, 215, and 220 has a first layer 405, a second layer 410, a third layer 415, and a fourth layer 420. The first and the second layers 405, 410 form a first exterior fold; the third and the fourth layers 415, 420 form a second exterior fold; the second and the third layers 410, 415 form an interior fold. FIG. 4 also illustrates a crease 425 of the interior fold and an un-gusseted portion 430 of the polyethylene tube.

Figure 2A:
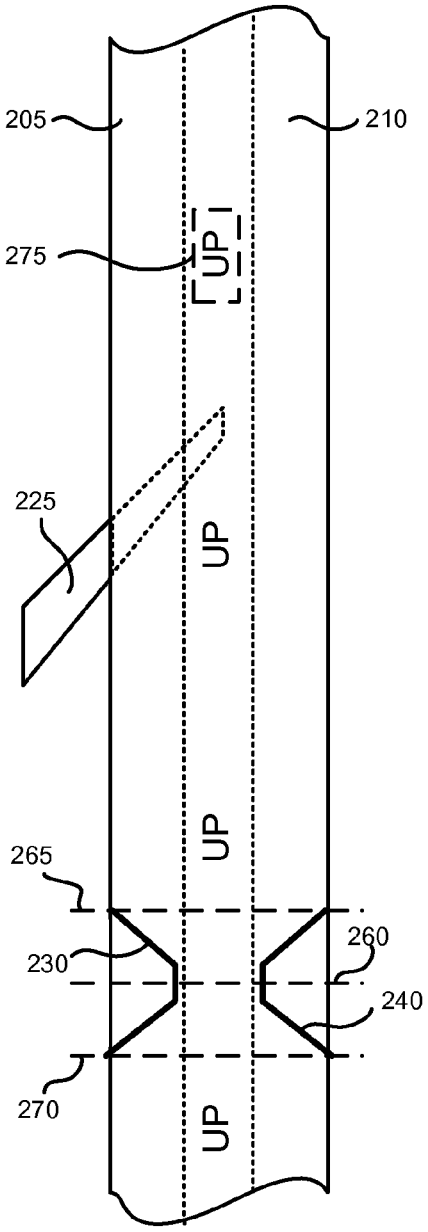
FIG. 2A is a plan view schematic of a slitting process and a welding process, according to a first embodiment of the invention.
Figure 2B:
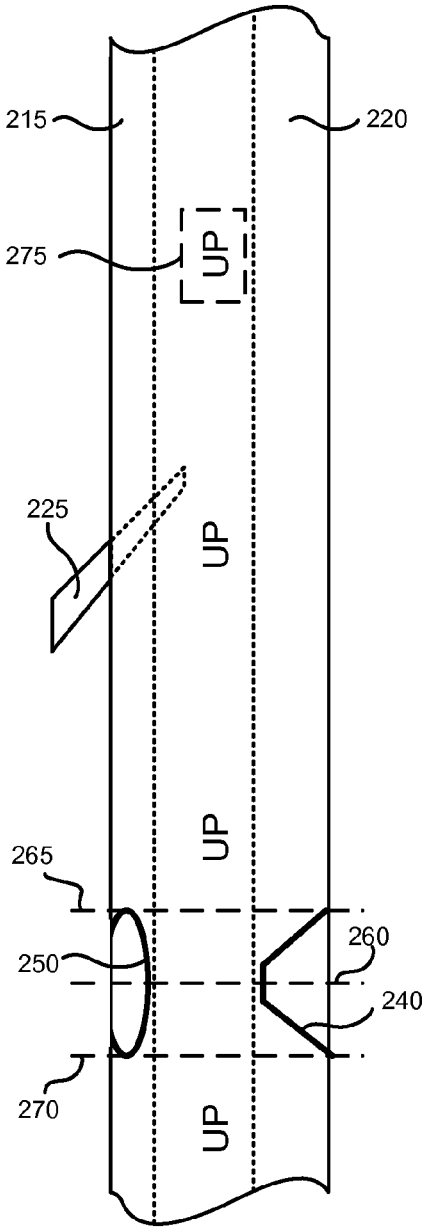
FIG. 2B is a plan view schematic of a slitting process and a welding process, according to a second embodiment of the invention.
Figure 3A:
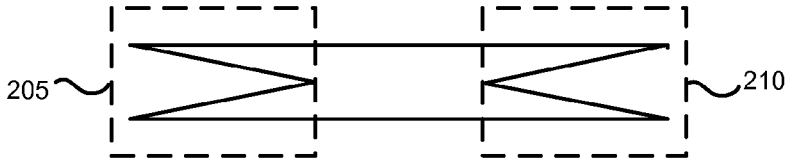
FIG. 3A is a sectional view of a gusseted polyethylene tube, according to the first embodiment of the invention.
Figure 3B:
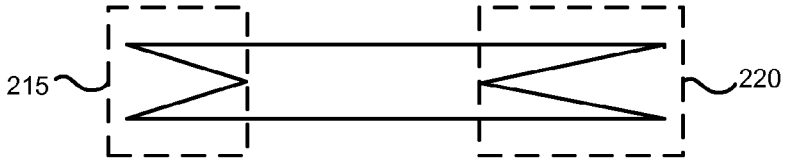
FIG. 3B is a sectional view of a gusseted polyethylene tube, according to the second embodiment of the invention.
Figure 5:
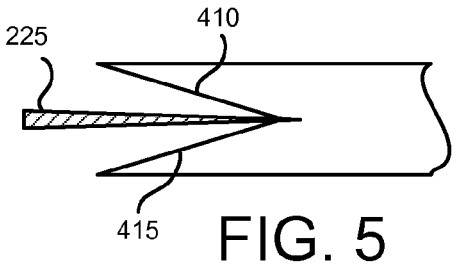
FIG. 5 is a sectional view of a gusseted polyethylene tube during a slitting process, according to the first and second embodiments of the invention.

In step 120, the process slits along the crease 425 of the interior fold of the first gusset 205, 215. With reference to FIGS. 2A, 2B, and 5, the slitting step 120 may be performed, for example, using a stationary knife 225 as the polyethylene tube is advanced (for example in web form on rollers) during manufacturing.

To provide reinforcement, the process welds a first and a second support structure in each of the first and second gussets in step 125. FIG. 2A illustrates a plan view of the first support structure 230 in the first gusset 205, and first support structure 240 in the second gusset 210, according to the first embodiment. A second support structure 235 (not visible in FIG. 2A) in the first gusset 205 has a shape that is identical to the first support structure 230. A second support structure 245 (not visible in FIG. 2A) in the second gusset 210 has a shape that is identical to the first support structure 240.

FIG. 2B illustrates a plan view of an alternative first support structure 250 in the first gusset 215, according to the second embodiment of the invention. A second support structure 255 (not visible in FIG. 2B) in the first gusset 215 has a shape that is identical to the first support structure 250.

Figure 6:
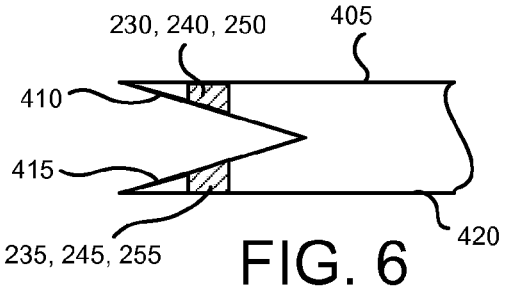
FIG. 6 is a sectional view of a gusseted polyethylene tube during a welding process, according to the first and second embodiments of the invention.

FIG. 6 is a sectional view of a gusseted polyethylene tube during a welding process, according to the first and second embodiments of the invention. As shown therein, the first support structure 230, 240, or 250 joins only the first and second gusset layers 405, 410, and the corresponding second support structure 235, 245, or 255 joins only the third and fourth gusset layers 415, 420.

To achieve uniform shaping, the support structures in the first gusset are preferably aligned with the support structures in the second gusset. With respect to the first embodiment illustrated in FIG. 2A, the first and second support structures 230, 235 (not shown) of the first gusset 205 and the first and second support structures 240, 245 (not shown) of the second gusset 210 are each centered about center line 260. Preferably, center line 260 is disposed on the polyethylene tube to be equidistant from adjacent print registrations 275. Also preferably, the width of support structures 230, 235 (not shown) in the first gusset 205 is approximately equal to the width of the support structures 240, 245 (not shown) in the second gusset 210, as illustrated by width markers 265, 270. FIG. 2B illustrates these same preferred alignment relationships for the second embodiment.

Figure 7A:
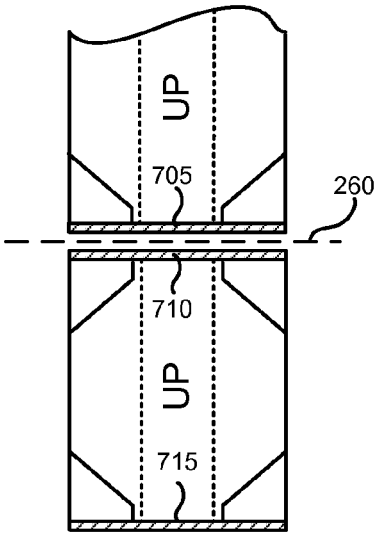
FIG. 7A is a plan view schematic of a cutting/welding process, according to the first embodiment of the invention.
Figure 7B:
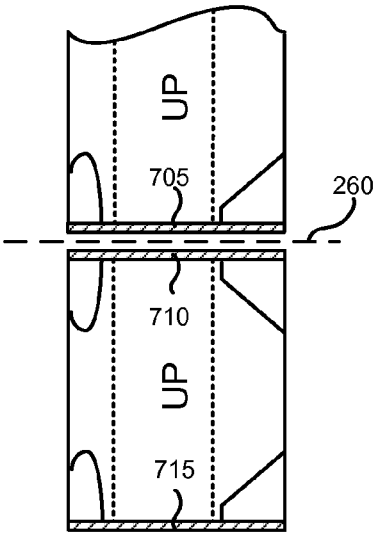
FIG. 7B is a plan view schematic of a cutting/welding process, according to the second embodiment of the invention.

Cut/weld step 130 includes the formation of two seam welds to close bag sides. Cut/weld step 130 also includes cutting the bag from the polyethylene tube. These steps are preferably performed simultaneously to maximize production throughput. The seam welding and cutting in step 130 is performed in a lateral direction (i.e., across the polyethylene tube). With reference to FIGS. 7A (first embodiment) and 7B (second embodiment), step 130 produces parallel seam welds 705 and 710 on either side of center line 260. The cutting in step 130 is performed at center line 260. FIGS. 7A and 7B also illustrate a seam weld 715 created in a prior execution of the cut/weld step 130.

In step 135, the process preferably transfers the bag separated in step 135 to a stack of bags.

Figure 8A:
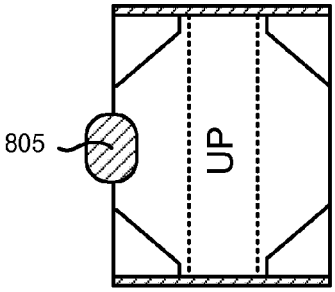
FIG. 8A is a plan view schematic of a punching process, according to the first embodiment of the invention.
Figure 8B:
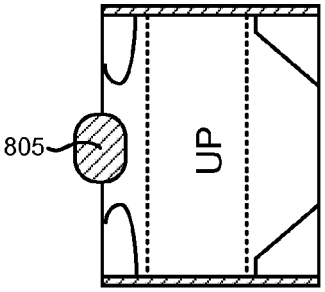
FIG. 8B is a plan view schematic of a punching process, according to the second embodiment of the invention.
Figure 9A:
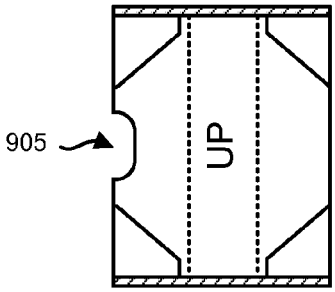
FIG. 9A is a plan view schematic of a completed bag, according to the first embodiment of the invention.
Figure 9B:
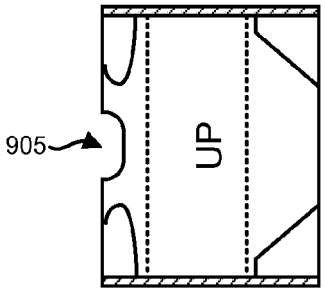
FIG. 9B is a plan view schematic of a completed bag, according to the second embodiment of the invention.
Figure 8C:
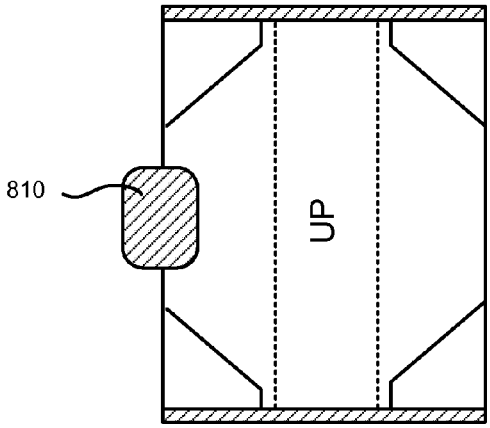
FIG. 8C is a plan view schematic of a punching process, according to a variation of the first embodiment of the invention.
Figure 8D:
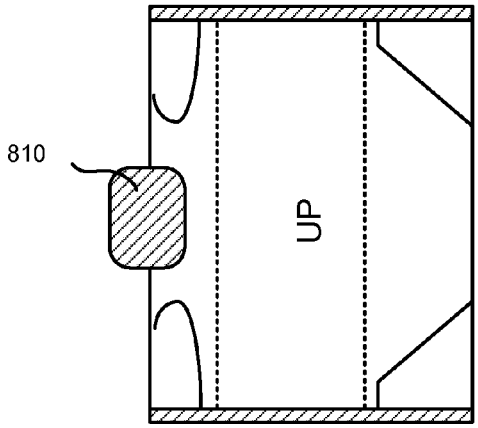
FIG. 8D is a plan view schematic of a punching process, according to a variation of the second embodiment of the invention.
Figure 9C:
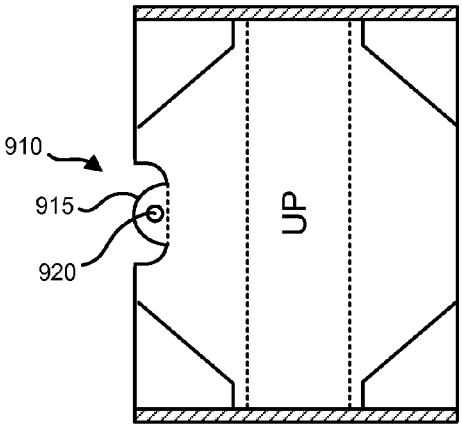
FIG. 9C is a plan view schematic of a completed bag, according to a variation of the first embodiment of the invention.
Figure 9D:
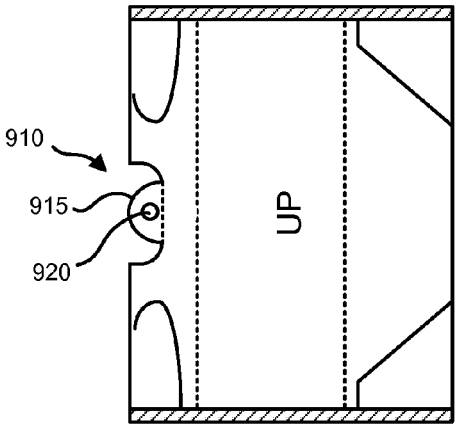
FIG. 9D is a plan view schematic of a completed bag, according to a variation of the second embodiment of the invention.

In step 140, the process removes a portion of the first gusset 205, 215 to form a handle in the bag. Step 140 may include, for instance, using a punch 805 as illustrated in FIGS. 8A (first embodiment) and 8B (second embodiment) to produce void 905 shown in FIGS. 9A (first embodiment) and 9B (second embodiment). In a variation of step 140, the process could use a punch 810 illustrated in FIG. 8C (a variation of the first embodiment) and 8D (a variation of the second embodiment) to form a void 910 that includes a tab 915 with a hole 920 as shown in FIGS. 9C (the variation of the first embodiment) and 9D (the variation of the second embodiment). The process terminates in step 145.

Other variations to the process illustrated in FIG. 1 and described with reference to other figures herein are possible. For instance, the thermoplastic tube received in step 110 could be or include polypropylene (PP), a combination of PE and PP, or other thermoplastic composition, according to application requirements. Alternative embodiments may not include the un-gusseted portion 430 in the tube. Step 125 could produce support structures having shapes that are not consistent with those illustrated in FIGS. 2A and 2B. Although seam welding and cutting are preferably performed simultaneously in cut/weld step 130 to maximize production throughput, these operations could be performed serially. Laser, water jet, or another cutting process could be used to remove a portion of the first gusset in step 140.

Manufactured Bags

Figure 10A:
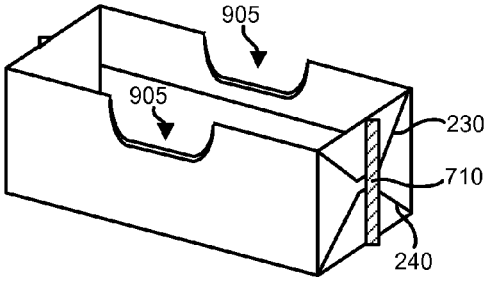
FIG. 10A is a perspective view of an opened bag, according to the first embodiment of the invention.
Figure 10B:
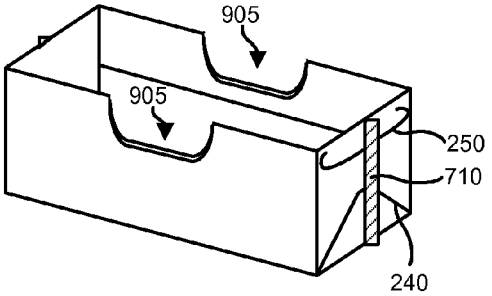
FIG. 10B is a perspective view of an opened bag, according to the second embodiment of the invention.
Figure 11:
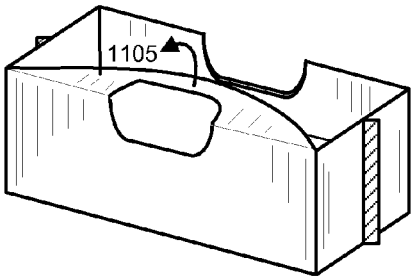
FIG. 11 is a perspective view of an opened bag illustrating handle extension, according to the first and second embodiments of the invention.
Figure 12:
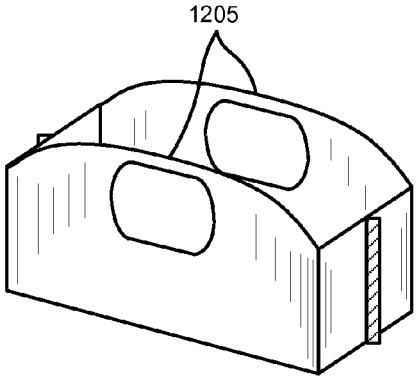
FIG. 12 is a perspective view of an opened bag with both handles extended, according to the first and second embodiments of the invention.

FIGS. 9A, 9B, 9C, and 9D illustrate manufactured bags laying in a flat and unexpanded condition that can be produced by the process described with reference to FIG. 1. FIGS. 10A, 10B, 11, and 12 illustrate opened bags where an expanded second gusset 210, 220 forms a floor of the bag. FIG. 10A shows supporting structures 230, 240 and seam weld 710 on one end of the bag, according to the first embodiment of the invention. FIG. 10B likewise illustrates supporting structures 250, 240 and seam weld 710 on one end of the bag, according to the second embodiment of the invention. Voids 905 are also visible in both FIGS. 10A and 10B. FIG. 11 illustrates how the first gusset 205, 215 is extended in a direction 1105 to convert the void 905 to a useable handle. FIG. 12 shows a bag with both handles 1205 fully extended.

SUMMARY

Embodiments of the invention thus provide a method for manufacturing a thermoplastic bag having a flat bottom and handles. The resulting bag is waterproof and may be less expensive to manufacture than a paper bag alternative. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention.

I claim:

1. A method for manufacturing a thermoplastic bag, comprising:

a) receiving a thermoplastic tube;

b) forming a first and a second gusset in the thermoplastic tube, each of the first and the second gussets having an interior fold, a first exterior fold, a second exterior fold, a first layer, a second layer, a third layer, and a fourth layer, the first and the second layers forming a first exterior fold, the third and the fourth layers forming the second exterior fold, the second and the third layers forming the interior fold;

c) slitting along a crease of the interior fold of the first gusset;

d) welding a first and a second support structure in each of the first and second gussets, the first support structure joining only the first and second layers, the second support structure joining only the third and fourth layers, the first and second support structures in the first gusset being aligned on the thermoplastic tube opposite the first and second support structures in the second gusset;

e) seam welding the thermoplastic tube in a lateral direction, the seam welding to include the first and second gussets, the seam welding producing two seam welds, each of the two seam welds being linear and parallel with respect to each other;

f) cutting the thermoplastic tube in a lateral direction to form a bag, the cutting being directed between the two seam welds and bisecting the first and second support structures in each of the first and second gussets; and g) removing a portion of the first gusset to form a handle in the bag.

2. The method of claim 1, wherein the thermoplastic tube includes polyethylene.

3. The method of claim 1, wherein the first gusset is narrower than the second gusset.

4. The method of claim 3, wherein the first and second support structures in the first gusset are curved, and each of the first and second support structures in the second gusset is formed with one or more straight weld lines.

5. The method of claim 1, wherein the first and fourth layers form a non-gusseted portion disposed between the first gusset and the second gusset.

6. The method of claim 1, wherein the seam welding and the cutting are performed simultaneously.

7. The method of claim 1, further including transferring the bag onto a stack of bags after the cutting and before the removing.

8. The method of claim 1, wherein the removing includes punching.

9. The method of claim 1, wherein the handle includes a tab and the tab includes a mounting hole.

* * * * *